US005145058A

United States Patent [19]

Lee

[11] Patent Number: 5,145,058

[45] Date of Patent: Sep. 8, 1992

[54] NOTEBOOK COMPUTER KEY

[76] Inventor: Sam-San Lee, Fl. 12-3, No. 603, Tun-Hwa S. Rd., Taipei City, Taiwan

[21] Appl. No.: 730,628

[22] Filed: Jul. 16, 1991

[51] Int. Cl.[5] ..... H01H 13/00

[52] U.S. Cl. ..... 200/517; 200/292; 200/290; 200/530

[58] Field of Search ..... 200/341, 344, 345, 521, 200/530, 534, 250, 290, 292

[56] References Cited

U.S. PATENT DOCUMENTS

| | | | |
|---|---|---|---|
| 3,767,022 | 10/1973 | Olson | 200/521 X |
| 4,584,444 | 4/1986 | Nagashima | 200/534 X |
| 4,596,912 | 6/1986 | Hattori | 200/302.2 |
| 4,641,004 | 2/1987 | Keprda | 200/341 X |
| 4,720,609 | 1/1988 | Hochgesang | 200/517 X |
| 4,755,645 | 7/1988 | Naoki et al. | 200/517 X |
| 4,927,990 | 5/1990 | Aoki et al. | 200/517 |

FOREIGN PATENT DOCUMENTS

| | | | |
|---|---|---|---|
| 3521155 | 12/1986 | Fed. Rep. of Germany | 200/341 |
| 1235114 | 6/1971 | United Kingdom | 200/341 |

*Primary Examiner*—Ernest G. Cusick

*Attorney, Agent, or Firm*—Ladas & Parry

[57] ABSTRACT

A push button of a notebook computer key has a plate portion, a hook projection extending downward from the plate portion and having a distal outward hook end, and a conductive member spaced vertically downward from the plate portion. The hook projection extends into an upright hollow confining wall of a socket member. The top end of the socket member is provided with an inwardly extending peripheral flange to hinder movement of the distal hook end out of the receiving space to prevent detachment of the push button from the socket member. A circuit board is provided on a lower end of the socket member. An upright hollow guide projection extends from the circuit board and into the hollow confining wall of the socket member. The conductive member is disposed inside the guide projection. A resilient biasing member has a lower tubular section, an upper tubular section wider than the lower tubular section and supporting the plate portion of the push button, and a gradually expanding inclined section connecting the lower and upper tubular sections. The biasing member biases the conductive member away from the circuit board.

1 Claim, 2 Drawing Sheets

NOTEBOOK COMPUTER KEY

BACKGROUND OF THE INVENTION

1. Field of the Invention

This invention relates to a computer key construction, more particularly to a notebook computer key which has a more stable and durable construction.

2. Description of the Prior Art

There are, at present, two types of computer key constructions which are commonly used. The first type employs a microswitch that is attached to and actuated by a pressing action on a key cap. However, the size of this kind of computer key is relatively large and for this reason is seldom used in portable notebook computers.

The second type employs an electrical switch and is commonly used in portable notebook computers. Referring to FIG. 1, a conventional electric switch notebook computer key comprises a push button (A), a slightly convex support member (B), a resilient biasing member (C), a socket member (D) and a circuit board (E). The push button (A) has a slightly concave top portion (A1) with a downwardly extending peripheral flange (A2). A mounting projection (A3) extends downward from the rear side of the top portion (A1) to secure the push button (A) on the support member (B). The socket member (D) has an upwardly extending confining wall (D1) which defines a receiving space (D3) to receive the support member (B). The top edge of the confining wall (D1) is provided with an upwardly curving flange (D2) which corresponds with the shape of the support member (B). The support member (B) has one end provided with a downwardly extending flange (B1) which abuts the inner surface of the confining wall (D1). The support member (B) also serves as a dust protection layer to prevent dust from collecting on the circuit board (E). The resilient biasing member (C) is made of rubber and has a tubular support portion (C1), the top end of which abuts the rear side of the support member (B), while the bottom end of the same supports a conductive member (C4). The outer surface of the support portion (C1) is connected to a downwardly extending and gradually expanding cover portion (C2) that confines a receiving space (C5). The resilient biasing member (C) further includes a horizontally disposed cushion layer (C3) connected to the bottom edge of the cover portion (C2). The resilient biasing member (C) is provided on top of the circuit board (E). The bottom end of the confining wall (D1) tightly abuts the cushion layer (C3) to secure the biasing member (C) onto the circuit board (E). The portion of the circuit board (E) inside the receiving space (C5) is provided with silver powdery conductive strips (E1).

When the push button (A) is pressed, the support member (B) moves downward to compress the biasing member (C) and move the conductive member (C4) to contact the conductive strips (E1) on the circuit board (E) to signal a pressed key condition. When the applied force is released, the biasing member (C) expands to once more move the conductive member (C4) away from the conductive strips (E1) and break the electrical connection.

From the foregoing, it has been shown that the biasing member (C) provides the necessary force to return the push button (A) from the pressed key position to the initial unpressed key position. However, the elastic properties of the biasing member (C) gradually wears down after prolonged use of the above described computer key. Thus, the push button (A) cannot be properly returned to the initial unpressed key condition. Operation of the computer key eventually becomes impossible since the conductive member (C4) gradually comes into contact with the circuit board (E) because of wearing of the biasing member (C). Furthermore, because of the construction of the biasing member (C), the height of the computer key shown in FIG. 1 should be at least 14.00 mm, while the vertical distance traveled by the push button (A) from the initial unpressed key position to the pressed key position is generally at 3.5 mm.

SUMMARY OF THE INVENTION

Therefore, the main objective of the present invention is to provide a notebook computer key with a more durable and stable construction.

Another objective of the present invention is to provide a notebook computer key which can be easily assembled and disassembled.

Still another objective of the present invention is to provide a notebook computer key with a reduced height of at least 11.5 mm and a movable distance (i.e., the distance traveled by a push button of the computer key from an initial unpressed key position to a pressed key position) which is maintained at 3.0 mm.

Accordingly, the preferred embodiment of a computer key of the present invention comprises: a push button having a plate portion, a support projection extending downward from an intermediate portion of the plate portion, a hook projection extending downward from the plate portion and outwardly of the support projection and having a distal outward hook end, and a conductive member provided on a bottom end of the support projection; a socket member including an upright hollow confining wall defining a receiving space and having a top end provided with an inwardly extending peripheral flange, the hook projection extending into the receiving space, and the peripheral flange hindering movement of the distal hook end out of the receiving space to prevent detachment of the push button from the socket member; a circuit board provided on a lower end of the socket member; an upright hollow guide projection extending from the circuit board and into the receiving space of the socket member, the support projection extending into and being in sliding contact with the guide projection; and a resilient biasing member having a first tubular section tightly sleeved around the guide projection, a second tubular section wider than the first tubular section and abutting the plate portion of the push button, and a gradually expanding inclined section connecting the first tubular section and the second tubular section. The biasing member is disposed between the support projection and the hook projection and biases the conductive member away from the circuit board. When pressure is applied on the push button, the biasing member is compressed to thereby produce bending at the gradually expanding inclined section and move the conductive member downward so as to contact the circuit board and achieve electrical connection to indicate a pressed key condition.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 3:
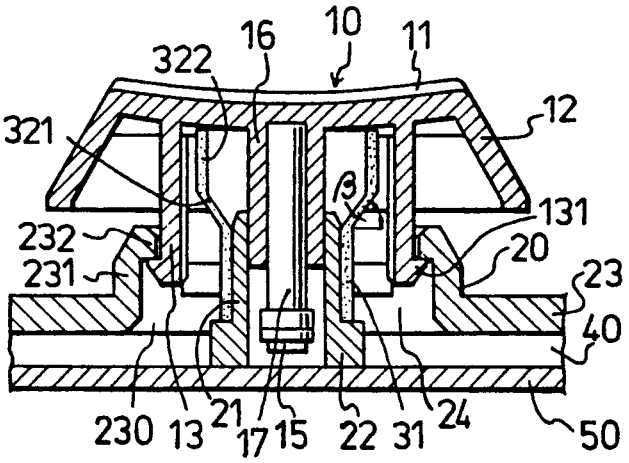
FIG. 3 is a sectional view of the notebook computer key taken along the section line 3—3 in FIG. 2, illustrating its assembly.
Figure 2:
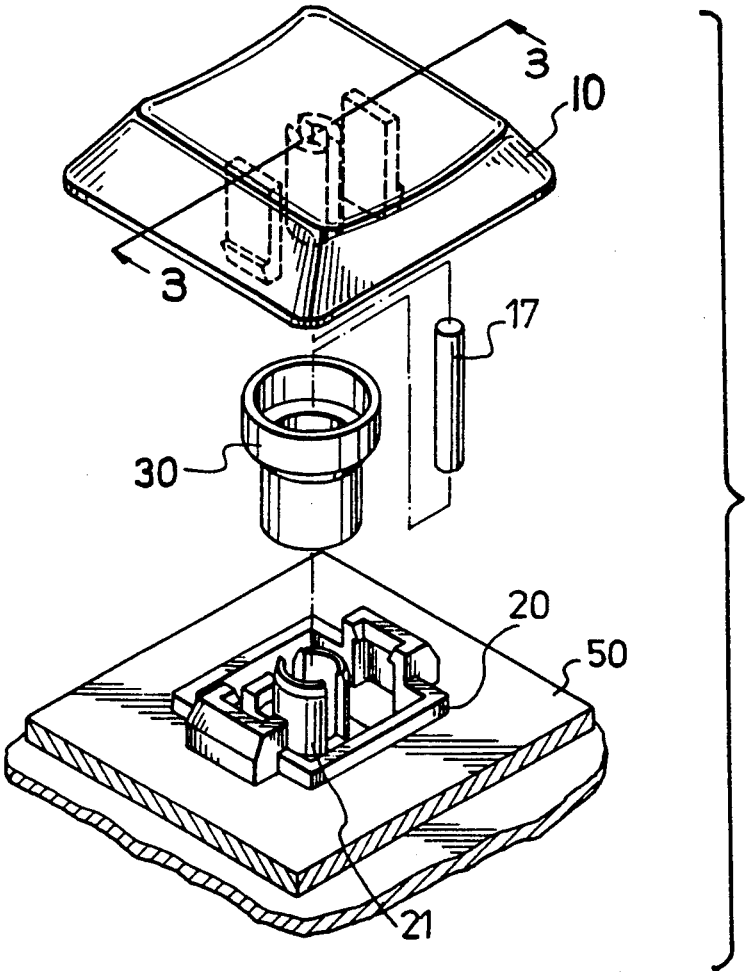
FIG. 2 is an exploded view of the preferred embodiment of a notebook computer key according to the present invention.

Referring to FIGS. 2 and 3, the preferred embodiment of a notebook computer key according to the present invention is shown to comprise a push button 10, a socket member 20, a resilient biasing member 30 and a circuit board 50.

The push button 10 has a slightly concave plate portion 11 with a downwardly extending and outwardly inclining peripheral flange 12. A substantially tubular projection 16 projects downward from the rear side of the plate portion 11 at an intermediate portion thereof. A cylindrical support stub 17 is fitted into the tubular projection 16. A conductive member 15 is mounted on a bottom end of the support stub 17. A pair of spaced hook projections 13 extend downward from the rear side of the plate portion 11 outwardly of the tubular projection 16. Each hook projection 13 is provided with a distal outward hook end 131.

The socket member 20 has a plate portion 23 with an opening 230 and an upright hollow confining wall 231 projecting from the periphery defining the opening 230. The confining wall 231 defines a receiving space 24 and has a top end provided with an inwardly extending peripheral flange 232. The hook projections 13 of the push button 10 extend into the receiving space 24 and the peripheral flange 232 hinders movement of the hook end 131 of the hook projections 13 out of the receiving space 24 to prevent detachment of the push button 10 from the socket member 20.

A plate 40 is provided between the plate portion 23 of the socket member 20 and the circuit board 50. The tubular projection 16 extends into and is in sliding contact with an upright hollow guide projection 21 extending from the circuit board 50 and into the receiving space 24 of the socket member 20. The guide projection 21 has a slightly enlarged lower portion 22 seated on the circuit board 50.

The resilient biasing member 30 is made of rubber and includes a first tubular section 31 sleeved around the guide projection 21 and with its a bottom end seated on the enlarged lower portion 22, a second tubular section 322 wider than the first tubular section 31 and abutting the plate portion 11 of the push button 10, and a gradually expanding inclined section 321 connecting the first tubular section 31 and the second tubular section 322. The biasing member 30 is disposed between the tubular projection 16 and the hook projections 13 and biases the conductive member 15 away from the circuit board 50. Thus, when pressure is applied on the push button 10, the biasing member 30 is compressed, thereby producing bending at the gradually expanding inclined section 321. Downward movement of the push button 10 correspondingly moves the support stub 17 and the conductive member 15 downward so as to contact the circuit board 50 and achieve electrical connection to thereby indicate a pressed key condition.

Figure 1:
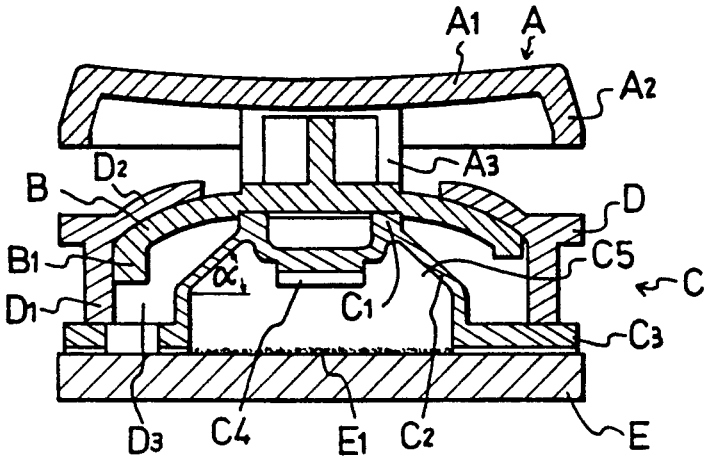
FIG. 1 PRIOR ART
FIG. 1 is a sectional view of a conventional notebook computer key.

The hook engagement between the hook projections 13 and the socket member 20 facilitates the assembly and disassembly of the push button 10 from the socket member 20. Referring to FIGS. 1 and 3, the angle of inclination ($\beta$) of the gradually expanding inclined section 321 of the biasing member 30 is greater than the angle of inclination ($\alpha$) of the gradually expanding cover portion (C2) of the biasing member (C) shown in FIG. 1. Thus, the biasing member 30 has better elasticity and is more sensitive than the biasing member (C). Less force is applied on the biasing member 30 to actuate the preferred embodiment, thereby reducing the wearing of the biasing member 30.

In order to improve the elasticity of the biasing member (C), the angle of inclination ($\alpha$) must be increased. This, however, causes a corresponding increase in the height of the computer key. Therefore, the objective of providing a computer key which is more stable, durable and smaller can be achieved by the notebook computer key of the present invention.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A computer key, comprising:

a push button having a plate portion, a support projection extending downward from an intermediate portion of said plate portion, a hook projection extending downward from said plate portion outwardly of said support projection and having a distal outward hook end, and a conductive member provided on a bottom end of said support projection;

a socket member including an upright hollow confining wall defining a receiving space and having a top end provided with an inwardly extending peripheral flange, said hook projection extending into said receiving space, said peripheral flange hindering movement of said distal hook end out of said receiving space to prevent detachment of said push button from said socket member;

a circuit board provided on a lower end of said socket member;

an upright hollow guide projection extending from said circuit board and into said receiving space of said socket member, said support projection extending into and being in sliding contact with said guide projection; and a resilient biasing member having a first tubular section tightly sleeved around said guide projection, a second tubular section wider than said first tubular section and abutting said plate portion of said push button, and a gradually expanding inclined section connecting said first tubular section and said second tubular section, said biasing member being disposed between said support projection and said hook projection and biasing said conductive member away from said circuit board;

whereby, pressure applied on said push button compresses said biasing member to produce bending at said gradually expanding inclined section and move said conductive member downward so as to contact said circuit board and achieve electrical connection to indicate a pressed key condition.

* * * * *